US007255346B1

(12) United States Patent
Madock

(10) Patent No.: US 7,255,346 B1
(45) Date of Patent: Aug. 14, 2007

(54) GALACTIC BOARD GAME METHOD AND APPARATUS

(76) Inventor: Daniel J. Madock, 1304 W. Busch Blvd., Tampa, FL (US) 33612

( * ) Notice: Subject to any disclaimer, the term of this patent is extended or adjusted under 35 U.S.C. 154(b) by 0 days.

(21) Appl. No.: 11/111,161

(22) Filed: Apr. 21, 2005

Related U.S. Application Data

(60) Provisional application No. 60/564,271, filed on Apr. 21, 2004.

(51) Int. Cl.
*A63F 3/00* (2006.01)

(52) U.S. Cl. ..... 273/239; 273/287

(58) Field of Classification Search ..... 273/239, 273/250, 253, 283, 284, 287
See application file for complete search history.

(56) References Cited

U.S. PATENT DOCUMENTS

| | | | |
|---|---|---|---|
| 3,765,679 | A | 10/1973 | O'Connell |
| 4,013,293 | A | 3/1977 | Hess et al. |
| 4,034,980 | A | 7/1977 | Sniderman |
| 4,043,558 | A | 8/1977 | Star |
| 4,083,564 | A | 4/1978 | Matsumoto |

*Primary Examiner*—Vishu Mendiratta
(74) *Attorney, Agent, or Firm*—Kenneth L Tolar

(57) ABSTRACT

A game method and apparatus includes a substantially circular game board configured to resemble a galaxy. A circular metallic ring borders the game board. A plurality of magnetic lighted game pieces are moved about the board in an attempt to approach a target game piece in the center of the board. If a player's game piece magnetically adheres to another game piece, the player who caused the event loses.

16 Claims, 1 Drawing Sheet

GALACTIC BOARD GAME METHOD AND APPARATUS

CROSS REFERENCE TO RELATED APPLICATIONS

This application is entitled to the benefit of provisional application No. 60/564,271 filed on Apr. 21, 2004.

BACKGROUND OF THE INVENTION

The present invention relates to a unique board game method and apparatus where players alternate moving magnetic star ship pieces within a simulated galaxy to approach without "capturing" a target piece or another game piece.

DESCRIPTION OF THE PRIOR ART

A myriad of board games and methods exist in the prior art. For example, U.S. Pat. No. 3,765,679 issued to O'Connell discloses a game including magnetic playing pieces that are moved about a substantially rectangular, magnetizable game board. The orientation of the game piece magnetic fields can be altered by rotating the game pieces. When a game piece is moved within a critical distance of an opponent's piece, one of the pieces will be "captured."

U.S. Pat. No. 4,013,293 issued to Hess et al. discloses a magnetic game apparatus including a game board that resembles a checkerboard. Both the squares and game pieces are magnetized to add randomness to the intended moves of the player.

U.S. Pat. No. 4,034,980 issued to Sniderman discloses a magnetic game board having two playing surfaces each configured similarly as a checkerboard. Game pieces having bar magnets therein are moved about the playing surface. Some spaces on the board have magnets thereunder that either repel or attract the game piece thereby causing the game pieces to flip and the board magnets to be repositioned.

U.S. Pat. No. 4,083,564 issued to Matsumoto discloses a board game including playing pieces having rotary carriages that display indicia corresponding to the number of moves that the piece is allotted. The board includes magnets positioned thereunder that rotate the carriages to randomly alter the display thereof.

U.S. Pat. No. 4,043,558 issued to Star discloses a magnetic maze game including a playing surface with a plurality magnets fixedly disposed thereon to define a course. A player attempts to move a magnetic playing piece through the course without the piece being attracted to one of the fixed magnets.

As indicated above, various magnetic game boards exist in the prior art. However, none of the above references, either individually or in combination, disclose a game board configured to resemble a galaxy having magnetic, lighted game pieces that are moved thereon. Nor do any of the above references include a rotatable grid beneath a game board that can randomly vary a magnetic field as does the present invention. The present invention provides an extremely unique board game whereby players alternate moving magnetic star ship pieces within a simulated magnetic galaxy in an attempt to closely approach a target.

SUMMARY OF THE INVENTION

The present invention relates to a galactic board game method and apparatus. The apparatus comprises a substantially circular game board having an upper surface configured to resemble a galaxy. The game board is peripherally bordered by a metallic ring that serves as a starting point for all game pieces. The game board and ring are mounted on a housing having a peripherally disposed slot on the edge thereof. The slot receives a circular metallic grid for alternating a magnetic field as described in more detail below. Game pieces are moved about the game board starting from a select position immediately adjacent to or on the peripheral ring. Each game piece includes a metallic cylinder formed of two separately rotatable sections mounted on a magnetic base. A top section includes a strobe light positioned beneath a transparent plastic dome. Rotating the upper section relative to the lower section activates the strobe light.

The game method according to the present invention includes placing a target game piece in the center of the game board while each player's pieces are placed about the periphery thereof, i.e. on the ring. Each player alternates moving one or more game pieces towards the target game piece in an attempt to closely approach the target without magnetically attracting another game piece. If a player's game piece magnetically attracts and adheres to another game piece or causes others to adhere, the player who caused the event loses or is eliminated from play.

It is therefore an object of the present invention to provide a board game method and apparatus that is unique.

It is another object of the present invention to provide a board game method and apparatus that simulates star or star ship movement within a galaxy.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
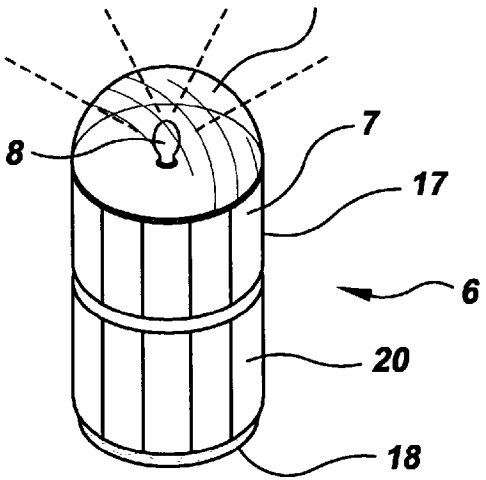
FIG. 2 is a perspective view of a game piece.
Figure 1:
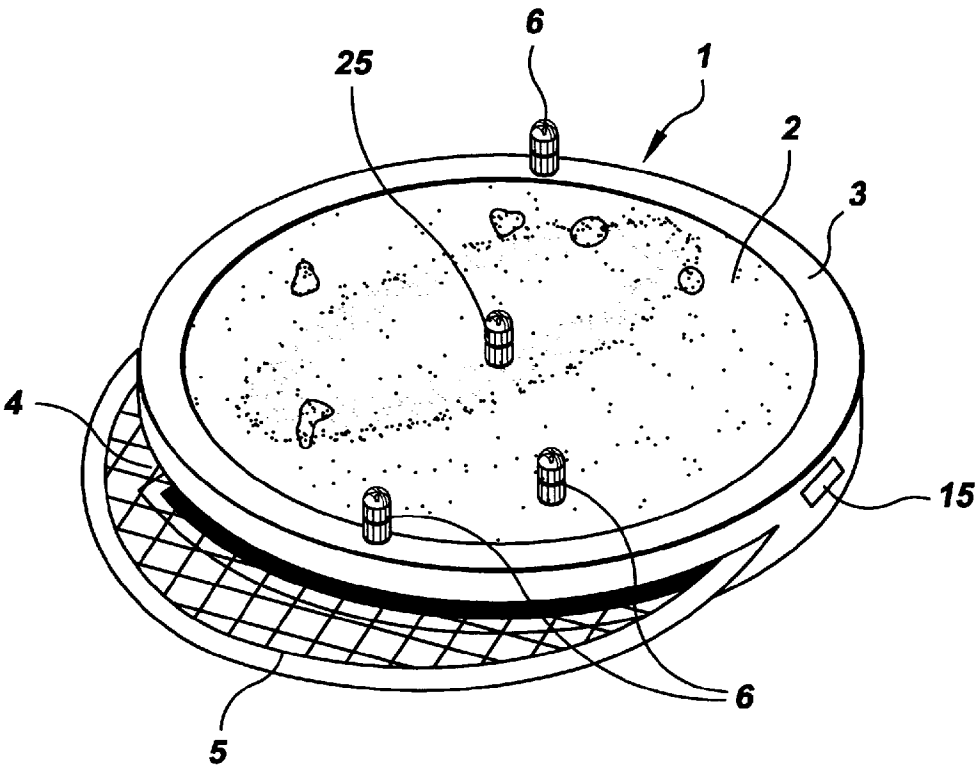
FIG. 1 is a perspective view of the game board apparatus.

The present invention relates to a galactic board game method and apparatus. The apparatus comprises a substantially circular game board 1 having an upper surface 2 configured to resemble a galaxy. The upper surface is preferably a removable placard that can be replaced with additional interchangeable placards to vary the galaxy appearance as desired. As such, each placard can be secured to the game board with a removable peg that is inserted into an aperture at the center of the placard and the game board.

The game board is peripherally bordered by a metallic ring 3 that serves as a starting point for all game pieces and which contributes to the magnetic field generated by magnetic game pieces described in more detail, infra. The game board and ring are mounted on a housing having a peripherally disposed slot 4 on the edge thereof. The slot receives an optional circular metallic grid 5 for alternating the magnetic field of the game board as described in more detail below.

Game pieces 6 are moved about the game board starting from a select position immediately adjacent to or on the peripheral ring. Each game piece includes a metallic cylinder 17 formed of two separately rotatable sections mounted on a magnetic base 18. An upper section 7 includes a strobe light 8 positioned beneath a transparent plastic dome 9. Rotating the upper section in a first direction relative to a lower section 20 activates the strobe light in a conventional fashion. Rotating the upper section in an opposite direction deactivates the light.

The game method according to the present invention includes placing a target game piece 25 in the center of the game board galaxy while each player's pieces are placed about the periphery thereof. Each player alternates moving one or more game pieces towards the target game piece in an attempt to closely approach the target without magnetically adhering to the target piece or another game piece(s). If a player's game piece magnetically attracts and adheres to another game piece or the target piece, the player who caused the event loses or is eliminated from play. The polarity of the magnetic base on each game piece is randomly selected such that each game piece will attract some game pieces while repelling others.

Alternate embodiments of the game method include installing the metallic grid within the slot to vary the magnetic field within the simulated galaxy. After each player moves a game piece, he or she has the option to rotate the grid a predetermined distance to further vary the magnetic field, thereby potentially causing the magnetic field to collapse and two or more game pieces to adhere. The grid is rotated with a dial 15 positioned on the periphery of the housing. The players can decide in advance whether the person rotating the grid or the opposing player loses in the event of game piece capture or adherence. The players can also decide beforehand whether each player is required to rotate the grid after each move.

The above described device is not limited to the exact details of construction and enumeration of parts provided herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A game method for at least two players comprising the steps of:

providing a game board having an upper surface configured to resemble a galaxy;

providing a plurality of magnetic game pieces;

designating one of said game pieces as a target game piece;

placing said target game piece at a center of said game board;

assigning a predetermined number of said game pieces to at least two players;

each player initially placing a plurality of game pieces adjacent a periphery of the game board;

each player alternating moving at least one assigned game piece towards the target game piece in an attempt to closely approach the target game piece without causing any game piece to magnetically adhere to the target game piece or another game piece.

2. The game method according to claim 1 further comprising the steps of:

positioning a metallic grid beneath said game board to alter a magnetic field associated therewith.

3. The game method according to claim 2 further comprising the steps of rotating said grid prior to each player moving a game piece to modify a magnetic field associated with said game board.

4. A game apparatus comprising:

a substantially circular game board having an upper surface configured to resemble a galaxy;

a metallic ring peripherally bordering said game board, said game board and ring mounted on a housing having a peripherally disposed slot on an edge thereof, said slot receiving a circular metallic grid for alternating a magnetic field associated with said game board;

a plurality of magnetic game pieces that are moved about the upper surface of said game board to approach a target game piece.

5. The game apparatus according to claim 4 wherein each game piece includes a metallic cylinder mounted on a magnetic base.

6. The game apparatus according to claim 5 wherein the magnetic base on each game piece has a different polarity than that of the magnetic base of a select number of other game pieces so that each game piece will attract a predetermined number of game pieces while repelling others.

7. The game apparatus according to claim 5 wherein each cylinder is formed of an upper section that is separately rotatable relative to a lower section, said upper section including a top end with a transparent dome thereon and a strobe light positioned beneath said dome.

8. The game apparatus according to claim 7 further comprising a switch means operably connected to said upper section whereby rotating the upper section in a first direction relative to the lower section activates the strobe light, and rotating said upper section in an opposite direction deactivates said light.

9. The game apparatus according to claim 4 wherein the upper surface of said game board is formed of a removable placard that is replaceable with additional interchangeable placards each having a unique galaxy configuration thereon to vary an appearance of the galaxy.

10. The game apparatus according to claim 4 further comprising a dial on the peripheral edge of said housing that is rotated to rotate said grid.

11. A game apparatus comprising:

a substantially circular game board having an upper surface configured to resemble a galaxy wherein the upper surface of said game board is formed of a removable placard that is replaceable with additional interchangeable placards each having a unique galaxy configuration thereon to vary an appearance of the galaxy; and wherein said game board and ring are mounted on a housing having a peripherally disposed slot on an edge thereof, said slot receiving a circular metallic grid for alternating a magnetic field associated with said game board;

a metallic ring peripherally bordering said game board;

a plurality of magnetic game pieces that are moved about the upper surface of said game board to approach a target game piece.

12. The game apparatus according to claim 11 further comprising a dial on the peripheral edge of said housing that is rotated to rotate said grid.

13. The game apparatus according to claim 11 wherein each game piece includes a metallic cylinder mounted on a magnetic base.

14. The game apparatus according to claim 13 wherein the magnetic base on each game piece has a different polarity than that of the magnetic base of a select number of other game pieces so that each game piece will attract a predetermined number of game pieces while repelling others.

15. The game apparatus according to claim 13 wherein each cylinder is formed of an upper section that is separately rotatable relative to a lower section, said upper section including a top end with a transparent dome thereon and a strobe light positioned beneath said dome.

16. The game apparatus according to claim 15 further comprising a switch means operably connected to said upper section whereby rotating the upper section in a first direction relative to the lower section activates the strobe light, and rotating said upper section in an opposite direction deactivates said light.

* * * * *